US009501886B2

(12) United States Patent
Scott-Brown

(10) Patent No.: US 9,501,886 B2
(45) Date of Patent: Nov. 22, 2016

(54) COIN FEEDER

(71) Applicant: Scan Coin AB, Malmo (SE)

(72) Inventor: Simon Scott-Brown, Newport Shropshire (GB)

(73) Assignee: SCAN COIN AB, Malmo (SE)

( * ) Notice: Subject to any disclaimer, the term of this patent is extended or adjusted under 35 U.S.C. 154(b) by 0 days.

(21) Appl. No.: 14/440,730

(22) PCT Filed: Nov. 5, 2013

(86) PCT No.: PCT/EP2013/073003

§ 371 (c)(1),
(2) Date: May 5, 2015

(87) PCT Pub. No.: WO2014/068129

PCT Pub. Date: May 8, 2014

(65) Prior Publication Data

US 2015/0294524 A1 Oct. 15, 2015

(30) Foreign Application Priority Data

Nov. 5, 2012 (GB) ..... 1219889.1

(51) Int. Cl.
*G07D 3/00* (2006.01)
*G07D 9/00* (2006.01)
*G07D 9/04* (2006.01)

(52) U.S. Cl.
CPC ..... *G07D 9/008* (2013.01); *G07D 3/00* (2013.01); *G07D 9/04* (2013.01)

(58) Field of Classification Search
CPC ..... G07D 3/00; G07D 9/008; G07D 9/04
USPC ..... 453/3, 29, 33, 34, 35, 49, 57
See application file for complete search history.

(56) References Cited

U.S. PATENT DOCUMENTS

| | | | | | |
|---|---|---|---|---|---|
| 4,993,990 | A * | 2/1991 | Ozeki | G07D 3/14 | 194/317 |
| 5,620,079 | A * | 4/1997 | Molbak | G07D 1/04 | 194/217 |
| 7,201,649 | B2 * | 4/2007 | Abe | G07D 3/06 | 453/29 |
| 8,668,559 | B2 * | 3/2014 | Bellis | G07D 9/008 | 453/33 |
| 2009/0227193 | A1 * | 9/2009 | Tanaka | G07D 1/02 | 453/3 |

FOREIGN PATENT DOCUMENTS

| | | | | |
|---|---|---|---|---|
| CN | 202486872 | * 10/2012 | | G07D 9/00 |
| GB | 2412221 | 9/2005 | | |
| GB | 2412221 A | * 9/2005 | | G07D 1/00 |
| WO | 99/53447 | 10/1999 | | |

* cited by examiner

*Primary Examiner* — Mark Beauchaine
(74) *Attorney, Agent, or Firm* — Hogan Lovells US LLP

(57) ABSTRACT

The invention provides a coin feeder for feeding coins to a coin sensor. The coin feeder comprises a hopper disc having a first surface and arranged to receive coins on the first surface, and to transport the coins along a first path towards the coin sensor. The coin feeder also comprises one or more coin deflectors to deflect coins received on the first surface from the first path if the coins are above a threshold thickness. At least one of the one or more coin deflectors comprises a rotatable member spaced from the first surface.

16 Claims, 9 Drawing Sheets

COIN FEEDER

This application is a U.S. National Phase under 35 U.S.C. §371 of International Application PCT/EP2013/073003, filed on Nov. 5, 2013, which claims priority to Great Britain Patent Application No. 1219889.1, filed on Nov. 5, 2012. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

The present invention relates to coin feeders for feeding coins to a coin sensor in a coin processing machine or assembly. Particularly the coin processing assembly is used for detecting, sorting, counting (or any combination of these) coins.

The term 'coin' is used herein to include any type of monetary token or token having value, metal currency, plastic or non-metallic token, a counterfeit coin, a component of a composite coin, or a washer for example. The coin may be disc shaped or generally disc shaped, or may be any other desired shape or generally planar form, such as square, oblong or oval for example.

Such machines are required to operate quickly and accurately. Typically the coin sorting rate is up to about 100 coins per second. It can be higher. It is important to transfer coins in an orderly manner to the coin sensor. In particular it is useful to transfer coins to the coin sensor in a manner such that they can be interrogated individually, in series. It is useful to avoid having to sense coins in parallel, or partly in parallel. Such parallel processing can happen, for example, if coins provided to the sensor are doubled up, overlapping or sitting on top of each other in any way. For example, see FIG. 1 for illustrations of potentially problematic coin arrangements. Since the sensor mechanism is designed to interrogate each coin individually, problems can occur such as recognising more than one coin as only one coin, or not correctly identifying a coin as genuine or bogus.

Coin feed mechanisms comprising hopper discs are known. The hopper discs are driven, for example clockwise. Inclined or tilted hopper disc feeders are known, as are horizontal hopper disc feeders. Hopper discs having a vacuum or suction mechanism for encouraging coins to sit flush, face to face, with the upper surface of the hopper disc are also known. For the avoidance of doubt, terms such as upper, lower, left or right are used in this specification, as relative terms and do not necessarily indicate orientation during use. For example, the upper surface of an inclined hopper disc is not substantially horizontal.

Generally, coins are arranged to be received on a hopper disc that rotates around a central axis. Coins are transported, usually around the circumference or periphery, of a hopper disc in a desired path towards a coin sensor. During the path, it is known to provide mechanisms for disturbing or deflecting coins that are provided in potentially problematic arrangements, such as shown in FIG. 1. Generally, these mechanisms work on the principle that a problematic arrangement can be detected due to the excess height or thickness of a pair of coins relative to an individual coin. As can be seen from FIG. 1, the height of a pair of problematic coins can vary. However, in all of the arrangements shown in FIG. 1, the height is greater than the height of a single coin.

Therefore it is known to provide a fixed, physical barrier that is spaced above the surface of the hopper disc in order to deflect at least the uppermost coin of a potentially problematic pair (or trio, etc). The spacing of the fixed barrier above the hopper surface is manually set according to the type or types of coins being processed within a given batch. Generally, batches are large and so it is not seen as particularly inefficient to adjust the height of these fixed barriers between batches if necessary. If a coin, for example, in a doubled-up arrangement, comes into contact with a fixed barrier, then it will be deflected from the desired path and most likely returned to an earlier stage of the path.

FIG. 2 shows a coin processing machine 200 (with its cover and some components removed for clarity) having a coin receiving tray (not shown), which is able to vibrate and feed coins onto a hopper disc 202 that rotates around a central axis 204. In this embodiment, the hopper disc 202 is inclined in normal use. The hopper disc has a vacuum mechanism so that coins received at its periphery are sucked onto its surface into face to face engagement. This promotes the transfer of coins via a desired path around the periphery of the hopper disc 202 in an orderly manner. This also promotes presentation of the coins individually in series to a sensor region 208. In the sensor region, a sensor (not shown) is used to identify each coin for subsequent processing, for example sorting into genuine and bogus coins, and counting the same. Depending upon the results as each coin passes the sensor region 208, the coins are carried on one or more belts towards collection bags along separate paths, dependent upon whether they are identified as genuine or bogus coins, and of what specific type (for example €1, €2, 50 cents, bogus washer etc).

Along the desired path around the periphery of the hopper disc 202, there are provided three fixed deflectors on this known machine—a first fixed deflector, 210, a second fixed deflector, 212 and a third fixed deflector, 214. The first and second fixed deflectors are similar to each other and so, for conciseness, only the first fixed deflector 210 will be described in detail.

The first fixed deflector 210 comprises a first lip at or near the outer edge of the hopper disc 202. The first lip initially follows the circular edge of the hopper disc such that it provides a guide for coins travelling in the desired path. The first lip is at about the same height (slightly raised above) as the upper surface of the hopper disc and so is able to effectively act as a guide. In a downstream direction, the first lip gradually becomes raised so that a standard coin is no longer guided by it due to its height above the surface of the hopper disc. The first lip then changes direction so that it no longer follows the outer edge of the hopper disc. Instead it diverges from the outer edge by curving inwards so that when a potentially problematic arrangement of coins, as shown in FIG. 1, is encountered, an uppermost coin will be guided by the first lip out of the desired path. The upper most coin is thereby deflected from the desired path and returns to an earlier location in the desired path via a combination of gravity and the rotation of the hopper disc.

The second fixed deflector 212 acts in a similar manner to the first fixed deflector 210.

As an estimate, the first fixed deflector deflects about 80% of all problematic coin arrangements. The second fixed deflector deflects most of the remainder leaving a few to pass to the third deflector.

The third fixed deflector 214 has a different form. In this embodiment the third fixed deflector 214 is a fixed, rigid plate. As can be seen in FIG. 2*c*, the third fixed deflector plate 214 has a curved edge 216. This curved edge 216 is raised above, and overhangs, the edge of the hopper disc 202. The curved edge 216 is arranged at a height such that single coins travelling along the desired path in series will not be affected by it—it is too high. The gap between the upper surface of the hopper disc 202 and the lower surface of the overhanging edge of the third fixed deflector 214 is sufficient to allow such coins to pass. The third fixed deflector 214 is mounted by a screw (not shown) to a fixed chassis upon which the hopper disc 202 is also mounted. The mounting screw can be used to adjust the height of the third fixed deflector 214 and thus the height of the overhanging edge 216. In this embodiment the edge is curved, but in other embodiments the edge may be straight.

The curvature of the edge 216 is selected such that a potentially problematic uppermost coin of a parallel pair is gradually deflected from the desired path. This is to reduce the likelihood of a problematic coin pair becoming jammed in the third fixed deflector 214. This is a known problem. Due to the velocity of the coins travelling along the desired path and the sturdy nature of the third fixed deflector 214, coins can sometimes become jammed or stuck in the deflector 214. The likelihood of this type of jam would be increased if the angle of the overhanging edge 216 was made more severe (i.e. closer to perpendicular relative to the desired path).

It is also known to have resiliently biased (for example coil sprung) rigid deflector plates. Such deflector plates might be of a form similar to the third fixed deflector (of FIG. 2*c*) and would be urged towards the hopper disc 202 so that when a potentially jamming pair of coins impacts upon it, it is able to move against the action of a spring (or other urging mechanism) away from the hopper disc slightly in order to provide deflection but avoid jamming. This provides some improvement (i.e. less jamming) but does not solve this problem completely.

In the event of such a jam, it is known to stop the coin processing machine, remove the coins causing the jam and restart the machine. It is also known in some machines to provide an electronic mechanism which reacts to a jam by reversing the direction of movement of the driven hopper briefly, for example for 10 seconds, in order to try to remove the jammed coins, and then to resume normal operation. If the frequency of jamming is thought to be too high, for example by a human operator of the machine, then the coin deflectors can be adjusted in height to allow a different (greater) height of coin to pass through the desired path in an unobstructed (undeflected) manner.

The present invention provides a coin feeder for feeding coins to a coin sensor, the coin feeder comprising: a hopper disc having a first surface and arranged to receive coins on the first surface, and to transport the coins along a first path towards the coin sensor; one or more coin deflectors to deflect coins received on the first surface from the first path if the coins are above a threshold thickness, wherein at least one of the one or more coin deflectors comprises a rotatable member spaced from the first surface.

Individual coins are able to pass in the gap between the rotatable member and the first surface, but two overlapping coins may not pass between the gap without coming into contact with the rotatable member. Coins are therefore presented to the coin sensor in an efficient and orderly manner.

Optionally the axis of rotation of the rotatable member is spaced, optionally radially outwardly, from an edge of the hopper disc.

Optionally the rotatable member comprises a wheel, such as a circular wheel.

Optionally the axis of rotation of the rotatable member is perpendicular to the first surface.

Optionally the axis of rotation of the rotatable member is inclined relative to the perpendicular to the first surface. In such examples, the lower surface of the rotatable member is not parallel to the first surface and so in the case of a potential jam, the natural rotation of the member is likely to clear the jam. This is because some parts of the lower surface of the rotatable member are closer to the first surface than others—the distance between the lower surface of the rotatable member and the first surface is not uniform, it is variable.

Optionally the rotatable member comprises a freely rotatable member. Therefore there is minimal inertia to overcome before the member rotates in case of an impact with coins travelling along the desired path.

Optionally the rotatable member comprises a resiliently urged member. The rotatable member may be provided or held in a datum position towards which it is urged. If the rotatable member is moved away from its datum position for example by coin impact then it is urged back towards the datum position. In general, coin impacts will deflect the rotatable member away from the first surface, so it will subsequently react back towards the first surface.

Optionally the coin feeder comprises a rotatable member assembly comprising a mounting plate to which the rotatable member is attached. Optionally the mounting plate is flexible and thereby provides the urging towards the datum position. Optionally the flexible plate comprises a leaf spring.

Optionally the rotatable wheel is mounted to the flexible plate using a deep groove ball bearing.

Optionally at least one of the coin deflectors comprises a fixed, rigid deflector optionally having a curved lip.

Optionally two such fixed coin deflectors are provided. Optionally both fixed deflectors are located upstream in the first path relative to the rotatable member.

According to another aspect of the invention there is provided a coin processing machine comprising: a tray for receiving coins; a mechanism for passing coins from the tray to a coin feeder; a coin feeder as claimed in any preceding claim; a coin sensing mechanism; and a coin sorting mechanism for sorting coins in response to an output signal from the coin sensing mechanism.

Embodiments of the present invention will now be described, by way of example only, with reference to the accompanying drawings in which:

FIG. 1 shows potentially problematic coin arrangements;

FIGS. 2*a* to 2*c* show a prior art coin processing machine having known height deflector mechanisms;

FIG. 3 schematically shows a coin deflector mechanism according to an embodiment of this invention;

Figure 1:
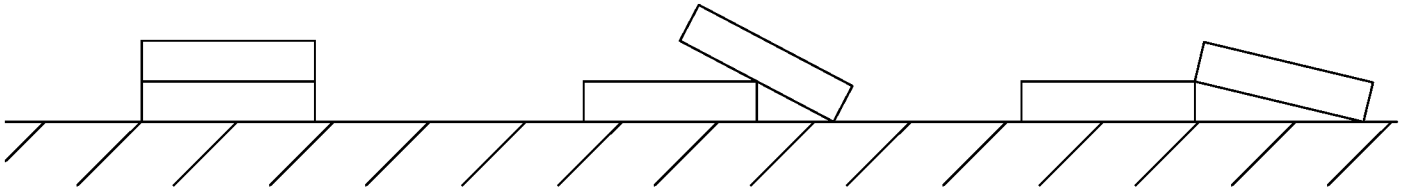
Figure 2A:
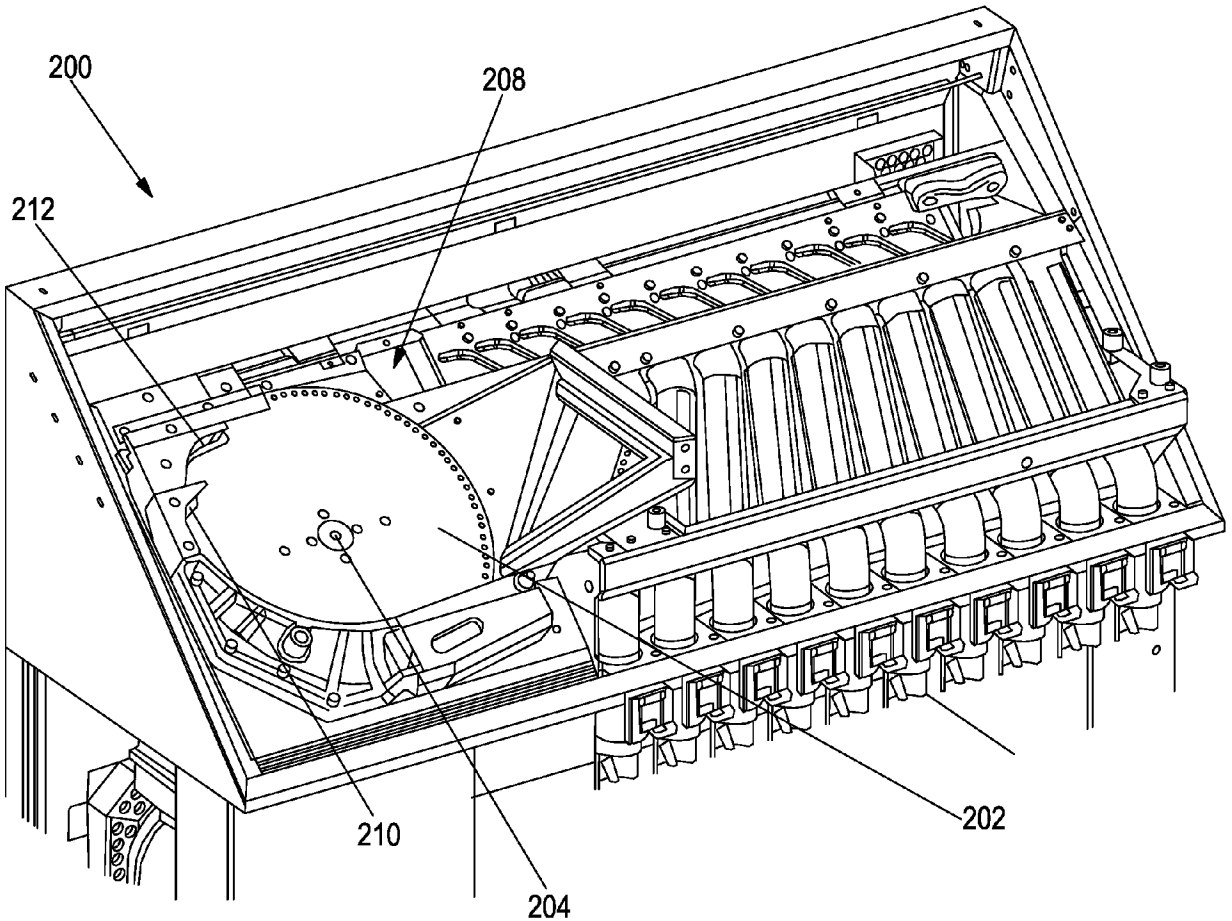
Figure 2B:
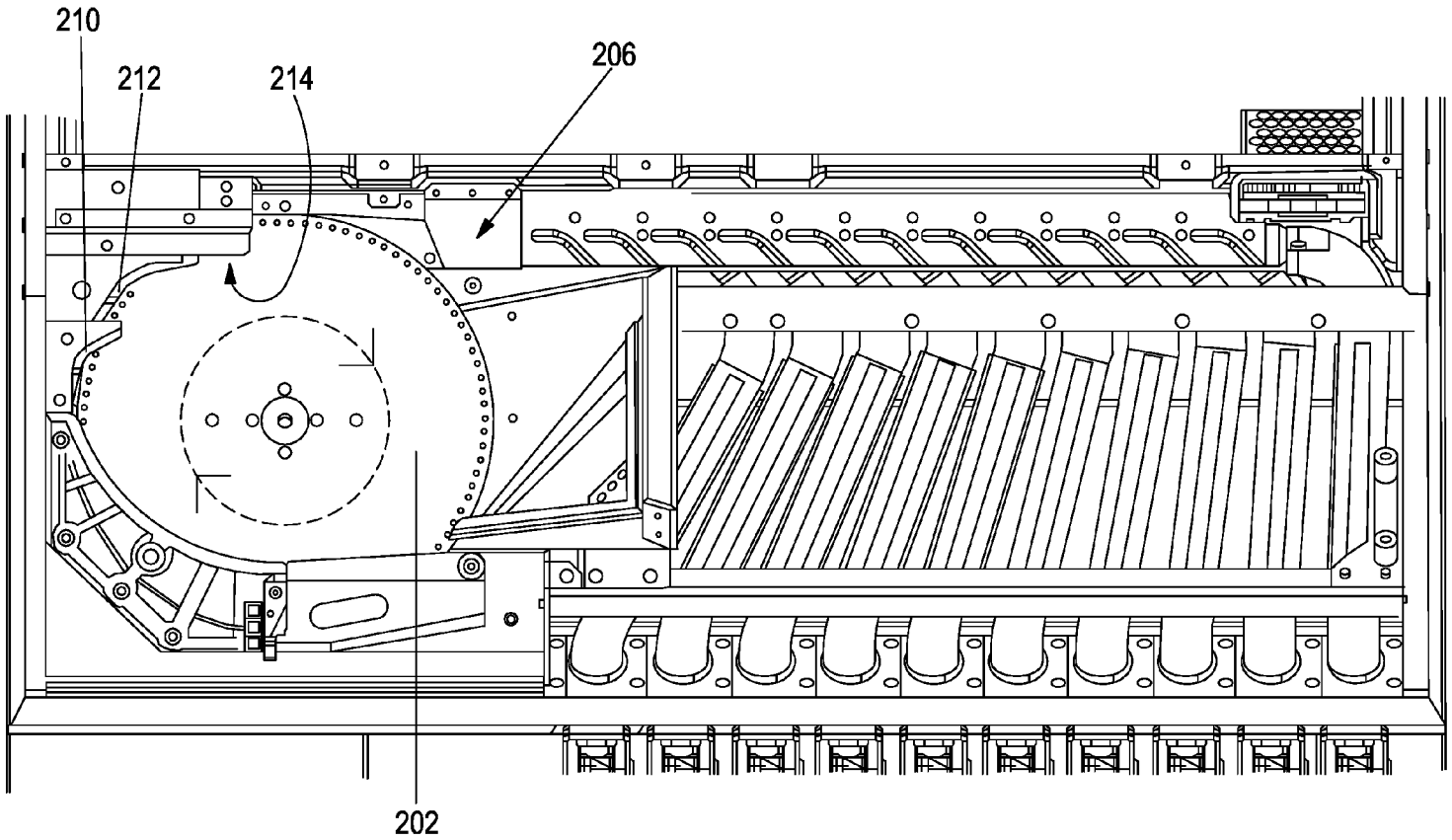
Figure 2C:
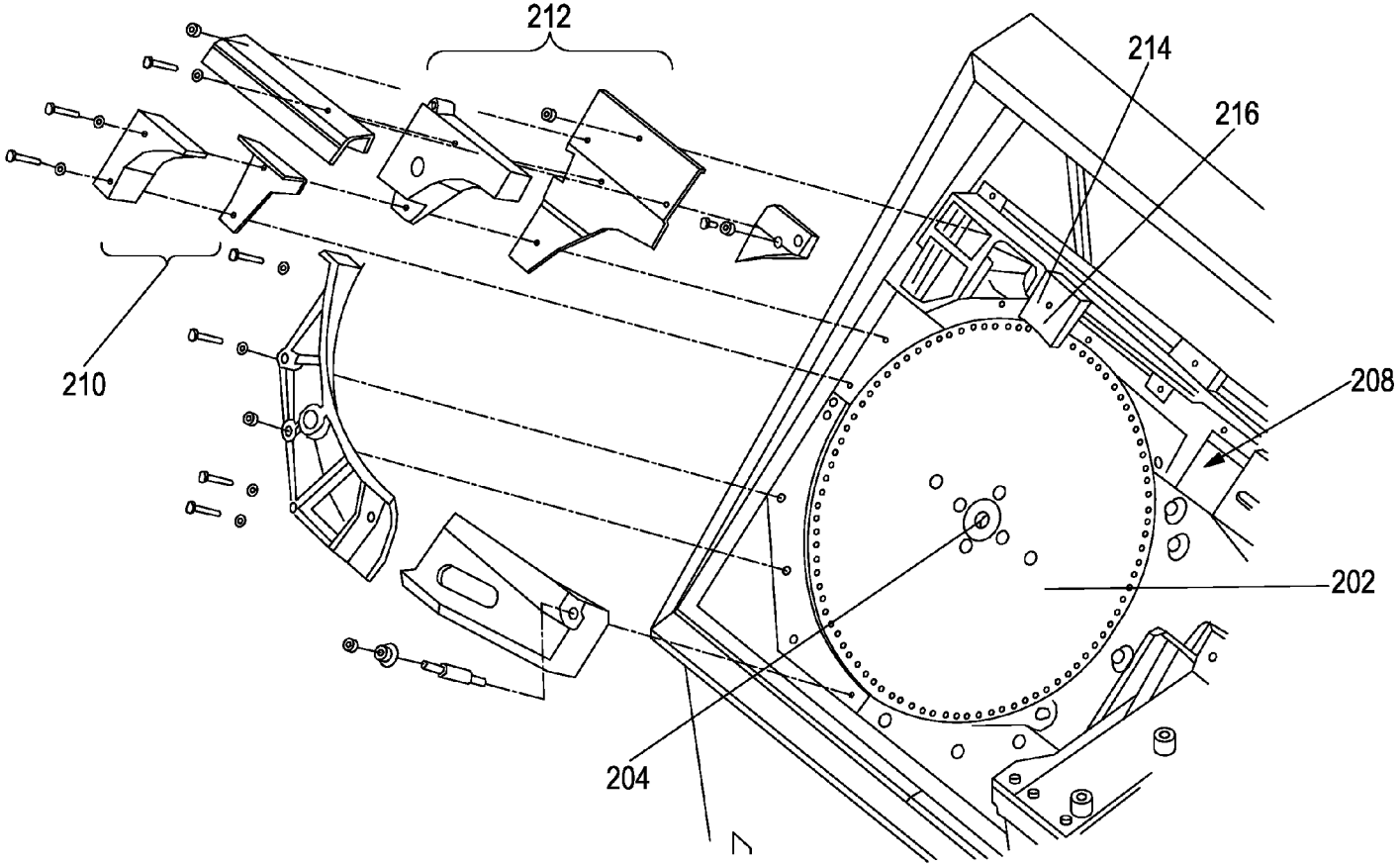
Figure 3:
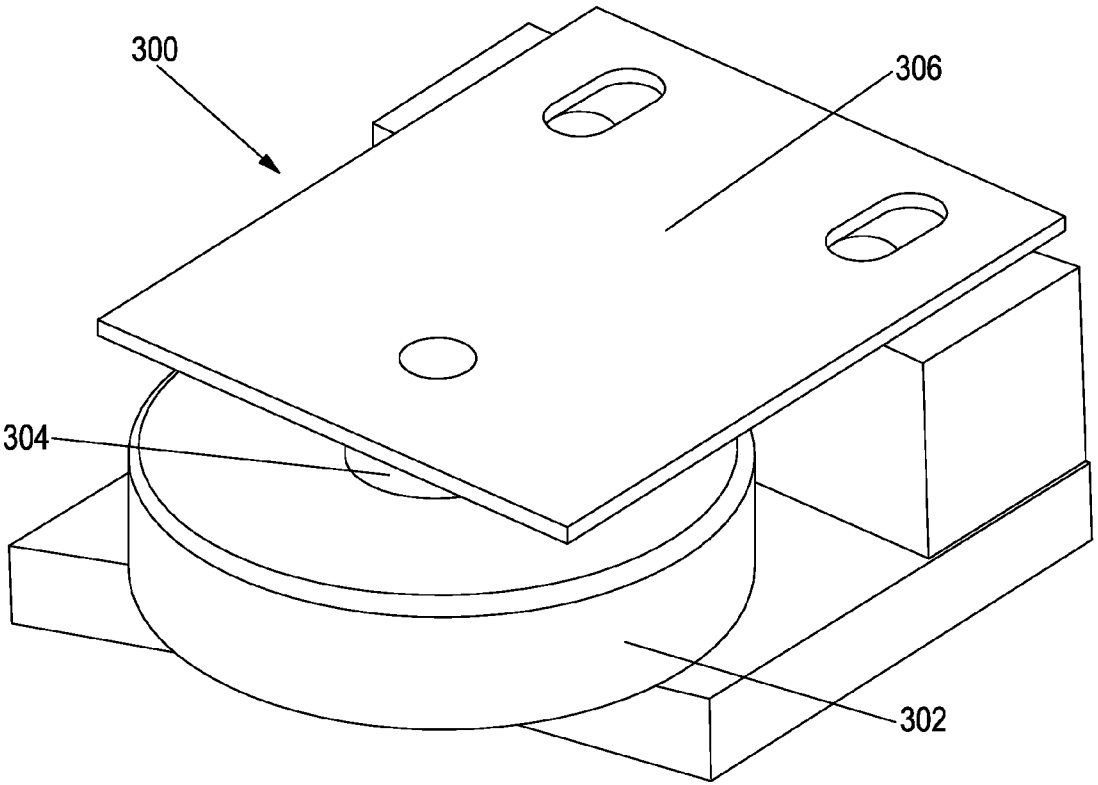

Referring to FIG. 3, there is shown a coin deflector 300 according to an embodiment of this invention. The coin deflector 300 comprises a rotatable member in the form of a rotatable wheel 302, freely rotatably mounted via a deep groove ball bearing 304 to a flexible mounting plate 306. The rotatable wheel is fixed in height relative to the mounting plate. The flexible mounting plate 306 is arranged to be fixed to a chassis of a coin processing machine. In use, this leads to the rotatable wheel being held in a datum position spaced relative to a hopper disc that is also fixed (although able to rotate in its fixed plane) relative to the chassis. The flexible mounting plate 306 comprises a leaf spring. The rotatable wheel 302 is thereby able to be held in a datum position by the flexible mounting plate 306 at a particular height that is suitable for deflecting problematic coin arrangements, but not individual coins travelling along a desired path for a particular batch of coins to be processed. The height of the rotatable wheel 302 can be adjusted by raising or lowering the mounting plate 306, and rotatable wheel 302 via a threaded attachment between the flexible mounting plate 306 and the chassis of the machine. A human operator may be able to do this directly or adjustment may be provided via an electronic controller, perhaps under the supervision of a human operator. Alternatively a computer program may control this operation.

Figure 4:
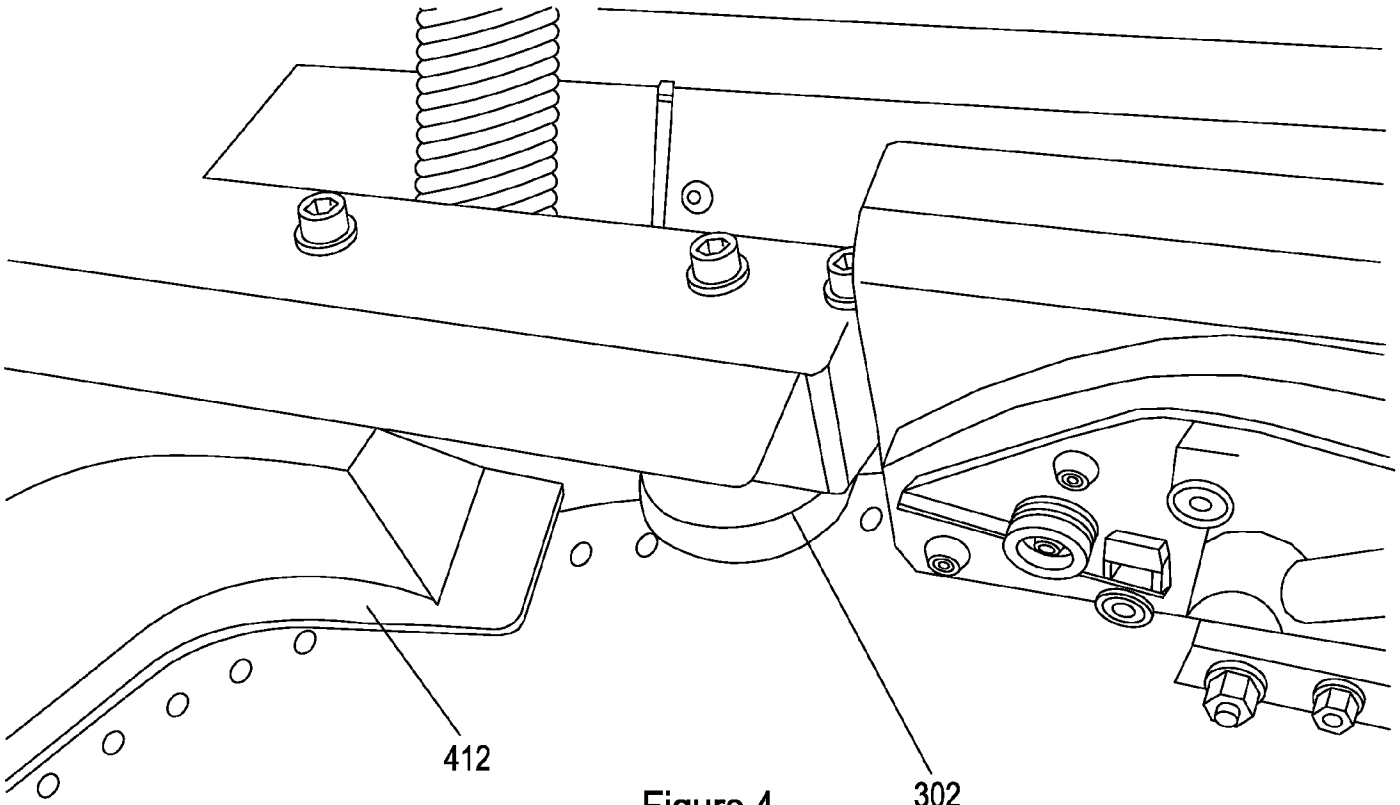
FIG. 4 shows a coin deflector mechanism according to this invention in place on a coin processing machine.
Figure 5:
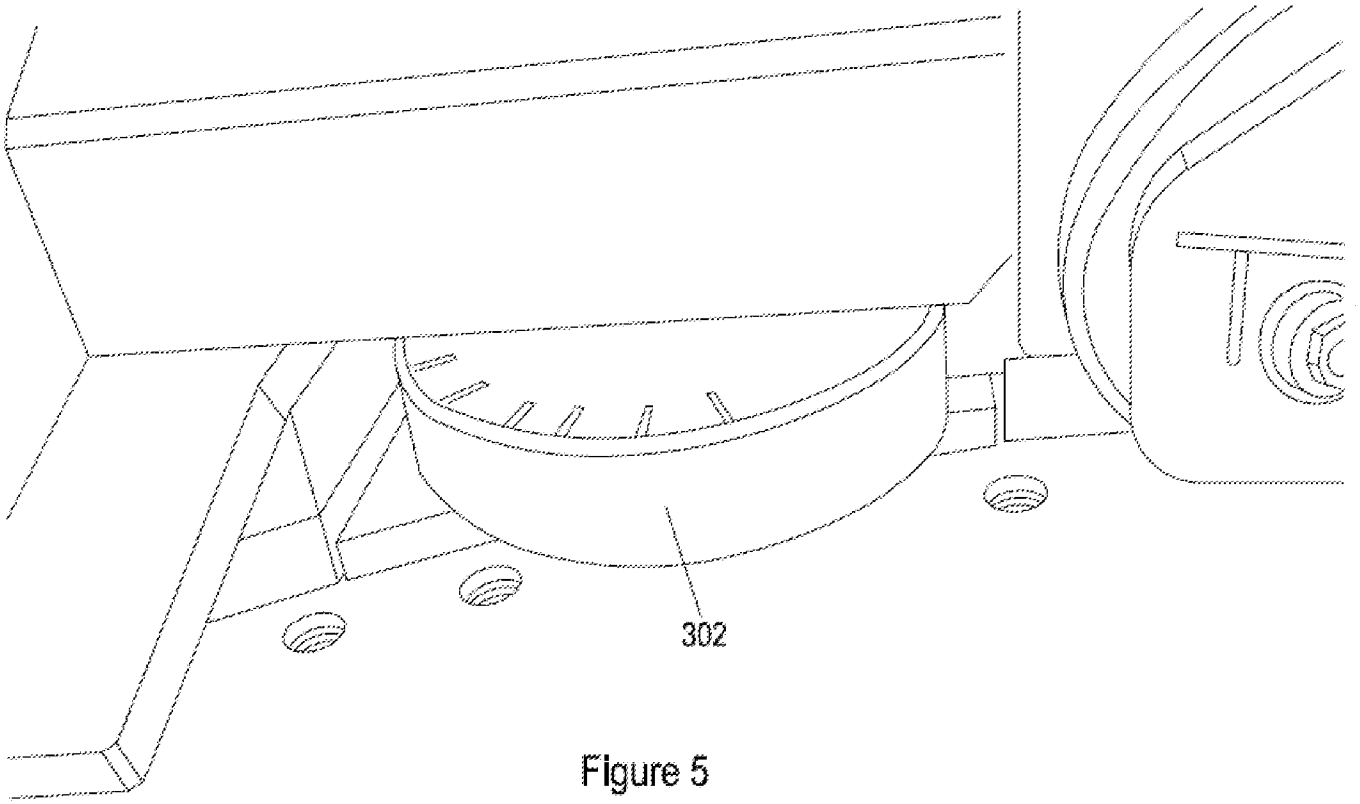
FIG. 5 shows a closer view of the coin deflector mechanism of FIG. 4.
Figure 6:
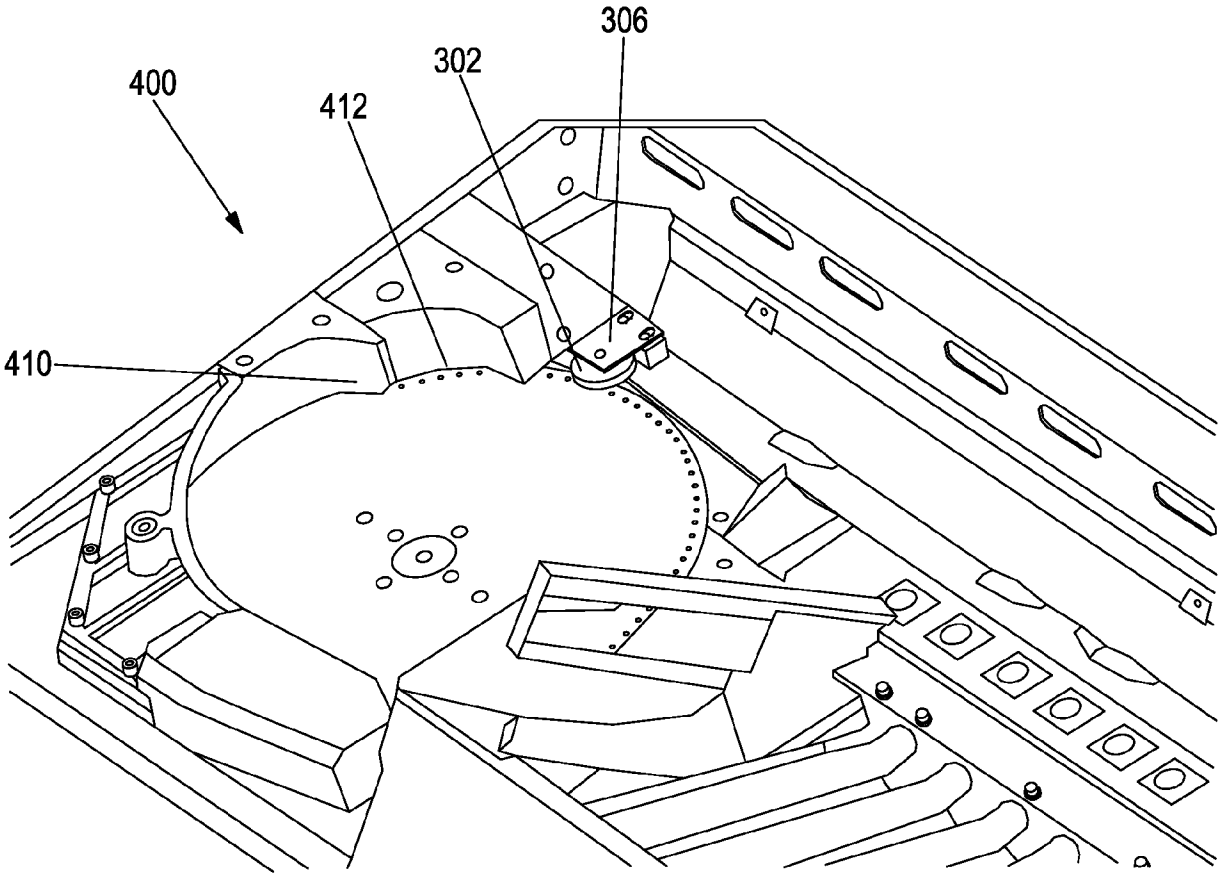
FIG. 6 schematically shows the deflector mechanism of FIG. 3 in place on a coin processing machine.

Referring to FIGS. 4 to 6, there is shown a coin processing machine 400 having first and second fixed deflectors 410, 412 in the form of first and second curved lips. These fixed deflectors 410, 412 are similar in form to previously described first and second fixed deflectors 210, 212. Other components of the machine 400 are similar to those of the previously described coin processing machine 200 and so will not be described again, for conciseness.

The coin deflector 300 has the same width as the third fixed deflector 214 described previously. It takes up no additional space. It can be used in combination with the first and second lips provided on existing machines. The first and second lips are expected to deflect much more than 80% of potentially problematic stacked coin arrangements.

The rotatable wheel 302 rotates around a bearing axis 308. The bearing axis 308 is offset, radially outwardly, from the edge of the hopper disc such that any coin travelling along the periphery of the hopper disc along the desired path will impact upon the rotatable wheel 302 in a direction that is not aligned with the pivot point i.e. the bearing axis 308. Therefore the impact of a potentially problematic pair of coins on the rotatable wheel 302 will cause the rotatable wheel 302 to rotate, instead of simply bouncing off, as might be the case if the direction of impact was aligned with the bearing axis.

As a result of this invention, testing has shown that the potential for jamming is significantly reduced relative to a fixed deflector of the type previously described. Jamming is also reduced relative to a resiliently urged rigid deflector. The rotatable wheel in this embodiment is freely mounted. In other embodiments the rotatable wheel may be urged in one or other direction (clockwise or anticlockwise).

In the case of a potential jam, an uppermost coin is sheared away from the lowermost coin in a problematic pair by the action of the driven hopper disc relative to the freely mounted rotatable wheel.

In other embodiments, a different bearing may be used other than a deep groove ball bearing. The deep grooved ball bearing 304 has an additional advantage in that it allows some degree of movement of the wheel outside its normal, datum plane. Effectively, the wheel is allowed to wobble slightly. In further embodiments the wheel is rigidly mounted, such that it is not able to wobble.

In the event of a potential jam, the impact of the coins on the wheel in this embodiment will cause the flexible mounting plate 306 to flex upwards (away from the hopper surface) briefly and to cause rotation of the wheel. Between these two actions, there is enough movement to allow deflection of the, or both, coins from the desired path without causing jamming at the deflector. After the deflection event, the flexible mounting plate 306 returns to its datum position. The flexible mounting plate 306 returns to its datum position quickly and allied to the relative low frequency of potential jams (since many of them are avoided by deflecting at the first or second fixed deflector), the flexible mounting plate 306 and the rotatable wheel 302 return to the desired datum position well in time for any subsequent potential jamming impact.

In this embodiment, the wheel is made up of hardened steel material. Also in this embodiment the wheel comprises a smooth upper and lower surface, and also a smooth edge surface. This is preferable to a roughened impact surface, which might promote jamming. Roughened surfaces will still work in some embodiments.

Figure 7A:
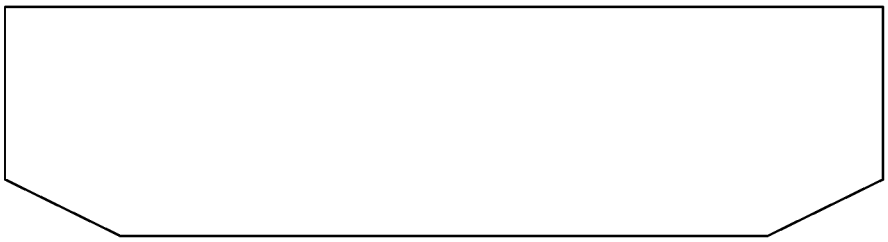
Figure 7B:
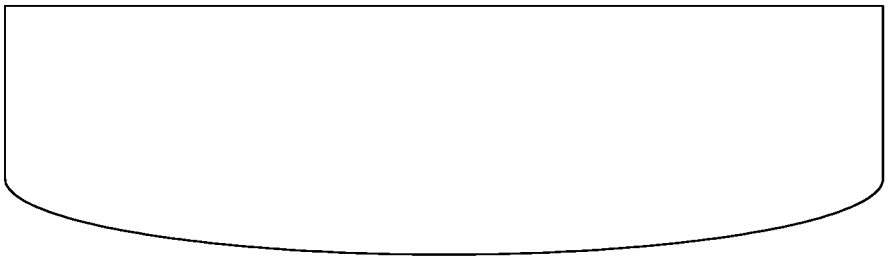

In other embodiments, a chamfered or bevelled edge may be provided between the lower surface of the rotatable wheel and the peripheral surface. The wheel may be thinner at its outer periphery compared to closer to its centre. FIGS. 7*a* and 7*b* schematically show side views of examples of such rotatable wheels. Again, this decreases the likelihood of jamming impacts. In particular the wheel shown in FIG. 7*a* reduces the likelihood of jamming impacts compared even to the wheel of FIG. 7*b*, due to the wheel of 7*a* not having a curved, bevelled edge, but instead having a 'straight-lined' bevelled profile.

Various modifications may be made to the present invention without departing from its scope. For example, a different type of spring may be used, other than a leaf spring for the flexible mounting plate—for example coil springs may be used, either pulling the rotatable member towards the hopper disc or pushing the rotatable member towards the hopper disc. A different shape of rotatable wheel may be used. For example, a rotatable gear wheel may be used.

In some embodiments more fixed deflectors may be provided. In other embodiments less fixed deflectors may be provided. In particular, in some embodiments, no fixed deflectors are provided—only the rotatable member is provided. In one embodiment the rotatable deflector may be provided upstream of a fixed deflector.

This invention works with both vacuum and non-vacuum hopper disc feeders. Both of these types of hopper disc feeder are well known.

For example, non-vacuum hopper disc feeders without any fixed deflectors are known. This invention can be used with such disc feeders, and in such arrangements only the rotatable deflector is provided.

This invention works with both horizontal and inclined hopper disc feeders. Both of these types of hopper disc feeder are well known.

The invention claimed is:

1. A coin feeder for feeding coins to a coin sensor, the coin feeder comprising: a hopper disc having a first surface and arranged to receive coins on the first surface, and to transport the coins along a first path towards the coin sensor; one or more coin deflectors to deflect coins received on the first surface from the first path if the coins are above a threshold thickness, wherein at least one of the one or more coin deflectors comprises a rotatable member spaced from the first surface; wherein the rotatable member is provided or held in a datum position towards which it is urged by a mounting plate to which the rotatable member is attached, and wherein the axis of rotation of the rotatable member is perpendicular to the first surface or inclined relative to the perpendicular to the first surface, and wherein further the mounting plate is flexible and thereby provides the urging towards the datum position.

2. The coin feeder of claim wherein the axis of rotation of the rotatable member is spaced, from an edge of the hopper disc.

3. The coin feeder of claim 1, wherein the rotatable member comprises a wheel.

4. The coin feeder of claim 1, wherein the rotatable member comprises a freely rotatable member.

5. The coin feeder of claim 1, wherein the rotatable member comprises a resiliently urged member.

6. The coin feeder of claim 1 further comprising a rotatable member assembly comprising a mounting plate to which the rotatable member is attached.

7. The coin feeder of claim 1, wherein, the rotatable member is mounted to the flexible plate using a deep groove ball bearing.

8. A coin processing machine comprising: a tray for receiving coins: the coin feeder of claim 1; a mechanism for passing coins from the tray to the coin feeder; a coin sensing mechanism; and a coin sorting mechanism for sorting coins in response to an output signal from the coin sensing mechanism.

9. The coin feeder of claim 1, wherein the axis of rotation of the rotatable member is spaced radially outwardly from an edge of the hopper disc.

10. The coin feeder of claim 1, wherein the rotatable member comprises a circular wheel.

11. The coin feeder of claim 1, wherein the flexible plate comprises a leaf spring.

12. The coin feeder of claim 11, wherein the rotatable member is mounted to the flexible plate using a deep groove ball bearing.

13. The coin feeder of claim 1, wherein at least one of the coin deflectors comprises a fixed, rigid deflector.

14. The coin feeder of claim 13, wherein two such fixed coin deflectors are provided.

15. The coin feeder of claim 14, wherein both fixed deflectors are located upstream in the first path relative to the rotatable member.

16. The coin feeder of claim 13, wherein the or each fixed, rigid deflector has a curved lip.

* * * * *